US005233894A

United States Patent [19]

Puett

[11] Patent Number: 5,233,894

[45] Date of Patent: Aug. 10, 1993

[54] APPARATUS AND METHOD FOR CUTTING FIBROUS AND OTHER PAPER TYPE SHEETS

[75] Inventor: Cecil E. Puett, Downey, Calif.

[73] Assignee: Sunclipse, Inc., Montebello, Calif.

[21] Appl. No.: 954,017

[22] Filed: Sep. 29, 1992

[51] Int. Cl.[5] ..... B26D 1/18; B26D 5/12

[52] U.S. Cl. ..... 83/56; 83/397; 83/452; 83/471.2; 83/477.2; 83/487; 83/578; 83/614; 83/639.1; 83/478

[58] Field of Search ..... 83/13, 56, 477.2, 453, 83/464, 487, 578, 649, 614, 639.1, 758, 397, 398, 471.2, 452, 478

[56] References Cited

U.S. PATENT DOCUMENTS

| | | | |
|---|---|---|---|
| 1,813,783 | 7/1931 | Tomlinson et al. | 83/471.2 |
| 1,920,591 | 8/1933 | Pesci | 83/578 X |
| 2,279,978 | 3/1942 | Currier | 83/578 |
| 2,870,802 | 1/1959 | Richards | 83/471.2 |
| 3,456,697 | 7/1969 | Rutzebeck | 83/471.2 |
| 3,779,121 | 12/1973 | Lagain | 83/639.1 X |
| 4,099,435 | 7/1978 | Young | 83/614 |
| 4,297,928 | 11/1981 | Benuzzi | 83/478 X |
| 4,771,667 | 9/1988 | Forman et al. | 83/477.2 X |
| 4,982,638 | 1/1991 | Brüssel | 83/614 |
| 5,120,386 | 6/1992 | Seki et al. | 83/614 X |

*Primary Examiner*—Frank T. Yost
*Assistant Examiner*—Clark F. Dexter
*Attorney, Agent, or Firm*—Beehler & Pavitt

[57] ABSTRACT

The apparatus comprises a housing having a pair of opposed side walls closed at their upper edges by a panel spanning the side walls with the panel being slotted between the side walls and depressible at least in the areas of either side of the slotting. Below and in line with the slot is mounted a rodless cylinder operable by air pressure deliverable at one end or the other of the cylinder as determined by a control device mounted on one of the side walls adjacent one end of the slot. A cutting element extends upwardly from the carrier of the rodless cylinder to move therewith. An arm is pivotably mounted on the opposite side wall from the central device and in line with the slot so that when the arm is brought down onto any sheet disposed on the top panel along the slot line, the arm depresses the sheet and underlying areas of the panel and simultaneously triggers the control device to move the cutting element along the slot to sever the sheet pressed down to meet the cutting element as it so moves.

6 Claims, 3 Drawing Sheets

APPARATUS AND METHOD FOR CUTTING FIBROUS AND OTHER PAPER TYPE SHEETS

FIELD OF THE INVENTION

This invention relates to the field of devices for cutting fibrous or other types of sheets fabricated of paper, cardboard, and other packaging materials.

BACKGROUND OF THE INVENTION

The conventional device for cutting sheets of different types of fibrous material has been what essentially is a type of scissors comprised of a stationary blade or metal edge against which is pivoted from one side, a blade, and between which edge and blade the sheet to be cut is disposed for cutting. A simple version of this type of cutter is that found in offices and commercial establishments.

More recently, a different type of cutter has been made the subject of a patent application of the present inventor viz. Ser. No. 07/755,688 filed Sep. 6, 1991. The cutter disclosed in this last mentioned application represents a substantial departure from the conventional scissor- type cutter in that, instead of any scissor-type action, the cutting is effected by a bladed wheel which is rolled across the sheet to be cut.

The conventional scissor cutter not only presents a hazard to the operator and the possibility that a finger or other portion of a hand may get caught between the blade and the stationary edge, but as the blade comes down across the sheet which is being cut, an undesirable pulling action may occur which may render the cut irregular and/or produce an undesirable pair of edges where the cutting occurs.

While this last undesirable feature is obviated by the applicant's cutter described in application Ser. No. 07/755,688, there remains a possible hazard to the operator since the blade or blades are moving across the top of the sheet and could, through carelessness, on the part of the operator or his assistant, result in injury to whoever may be manipulating the sheet as it is being cut.

SUMMARY OF THE INVENTION

The present invention avoids the problems with prior art cutters in that, as in applicant's prior cutter, no scissor action is provided but, in addition, the cutting element is disposed below the platform on which the sheet to be cut is placed and does not protrude above that platform. Consequently, it is almost impossible for an operator to be injured by the movement of the cutting element. In addition, in contrast to the scissor- type cutter, instead of the cutting occurring in the direction of the operator, the cutting of the present invention is effected in a direction away from the operator.

The advantages thus described are accomplished by the present invention which, in its present preferred embodiment, is constructed with a rectangular housing covered by a planar top side panel formed of a metallic sheet having a rectilinear slot extending from one side to the opposite side and normal to both sides. The thus slotted sheet is slightly depressible, particularly in the area in the vicinity of the slot. The rectangular housing may be supported above the ground surface so that the top side panel may be at the height of the waist or stomach of the average operator. Inside the housing and below the top side panel, and parallel to the slot, a rodless cylinder may extend from one side of the housing to the other. The rodless cylinder is provided with a magnet to move a carrier mounted on the outside of the cylinder and on which carrier may be mounted, a plastic block, the upper side of which block supports a cutter wheel which projects above the upper face of the carrier block. To support the block in such a manner that the cutter wheel will always be maintained in a vertical orientation, the block may be provided with orifices parallel to the rodless cylinder and, at least one, and preferably two, support rods, also parallel to the rodless cylinder, may be mounted to extend between the side walls of the housing. The rodless cylinder, its carrier and the support block are of such size and disposition that the upper edge of the cutting wheel carried by the block extends to just below the slot in the sheet when the sheet is not depressed.

The rodless cylinder is operated by compressed air which at any one time is supplied at one or the other of the two ends of the cylinder. Control of the air supply to one or the other end of the cylinder may be accomplished by providing a precision limit valve on the outside of one side wall of the housing in line with the slot. This precision limit valve is connected to a source of compressed air with one of its outer ports connected to the forward end of the rodless cylinder and the other valve connected to the rear end of the cylinder. A control switching element is extended upwardly in alignment with the slot.

A lever arm is pivotally mounted on the opposite side of the housing from the precision limit valve and in line with the slot in such a manner that, when the lever is pivoted from an upwardly extending neutral position down onto the top panel along the edges of the latter which define the slot, the outer end of the lever arm depresses the upwardly extending control switching element, while the arm simultaneously exerts a downward pressure on any sheet disposed on the top panel across the slot. Thereby, compressed air is forced into the end of the rodless cylinder adjacent the precision limit valve to drive the carrier along a line below and parallel to the slot with the result that the cutting element is moved against that portion of the sheet which covers the edges of the top panel defining the slot. Such travel of the carrier on the rodless cylinder continues until it reaches the end of the slot or until the outermost end of the lever arm is elevated to discontinue downward pressure on the upwardly extending control switching element. As soon as such elevation occurs, the precision limit valve shifts the compressed air supply to the opposite end of the rodless cylinder, thereby driving the carrier immediately back to its original position adjacent the side of the housing on which the precision limit valve is mounted.

While movement of the carrier in the preferred embodiment is effected by a rodless cylinder powered by compressed air in the manner described above and hereinafter further detailed, reciprocation of the carrier could also be accomplished by a reversible electric motor actuated by switching electric currents to effect such reversal of the direction of movement of the carrier.

DESCRIPTION OF THE PREFERRED EMBODIMENT

Figure 1:
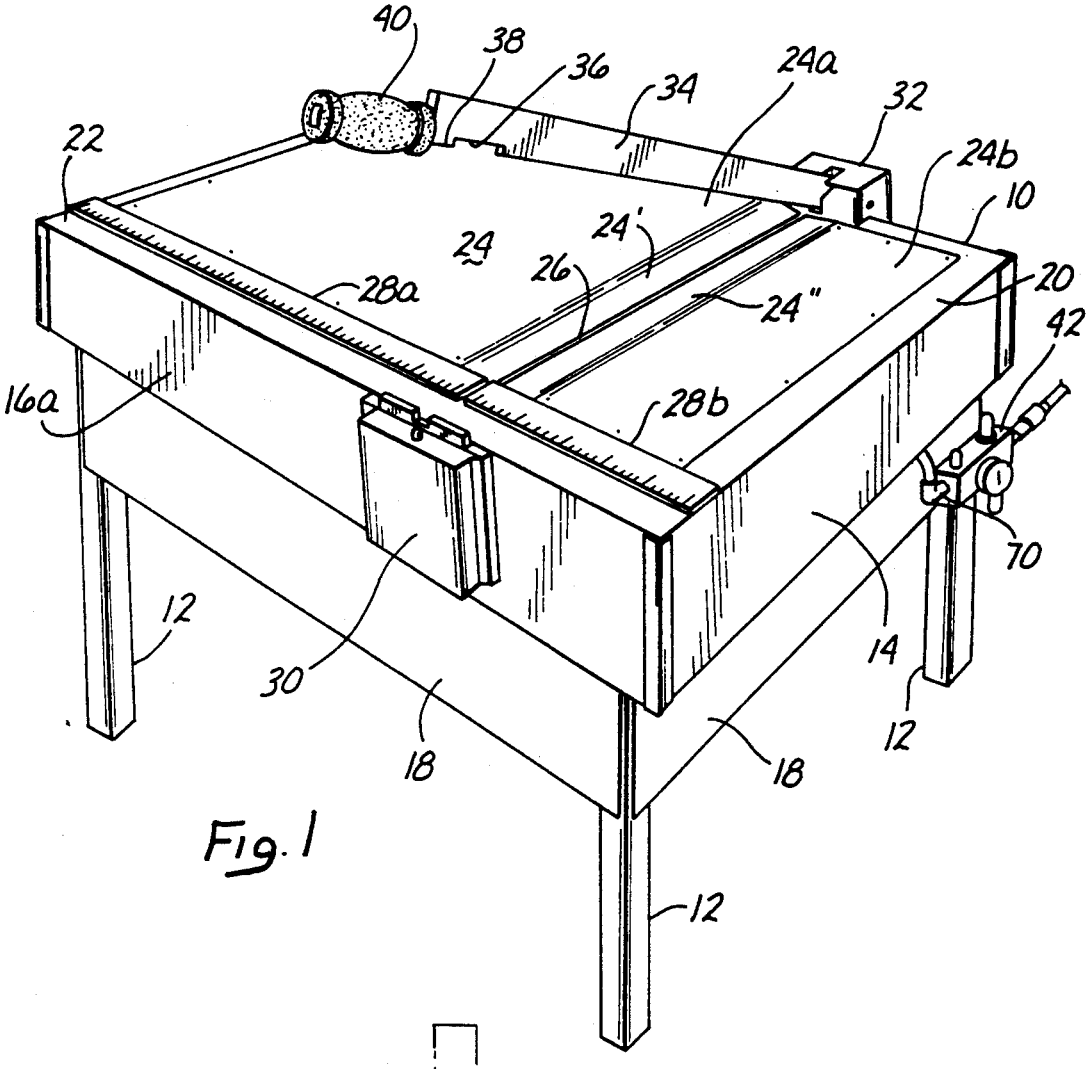
FIG. 1 is a perspective view of the preferred embodiment of the invention.

Referring initially to FIG. 1 of the drawings, the apparatus of the present invention includes a rectangular housing 10 supported above the ground surface and formed of vertical end panels 14 and side panels 16*a* and 16*b*. Below the actual housing 10 are skirting panels 18 that interconnect legs 12.

The end and side panels 14 and 16*a* and 16*b*, respectively, may be capped along their upper edges with flange portions 20 and 22 to which may be secured a top panel 24 which is slotted transversely between panel 16*a* and 16*b* at 26. Alternatively, the top panel 24 could actually be formed in two sections 24*a* and 24*b* with their edges being brought together but spaced apart to provide a narrow slot 26. At least the areas 24' and 24" should be depressible downwardly out of plane of the top panel 24. In addition, rectilinear scales 28*a* and 28*b* may be provided along the flange portions 20 and 22. A control box 30 which will be more fully described may be mounted on the side panel 16*a*. On the opposite side panel 16*b* a pivot block 32 may be secured from which pivot block 32 extends outwardly toward the opposite side panel 16*a* an arm 34 in alignment with slot 26. As may be seen, scale 28*a* terminates at the left side of the slot 26, while scale 28*b* terminates on the right side of that slot. The arm 34 desirably is notched at 36 leaving a small land 38. The outer end of the arm 34 may be provided with a handle 40. A Watts cube air pressure regulator 42 may be mounted on the right-hand rear leg 12 as shown in FIG. 1.

Figure 5:
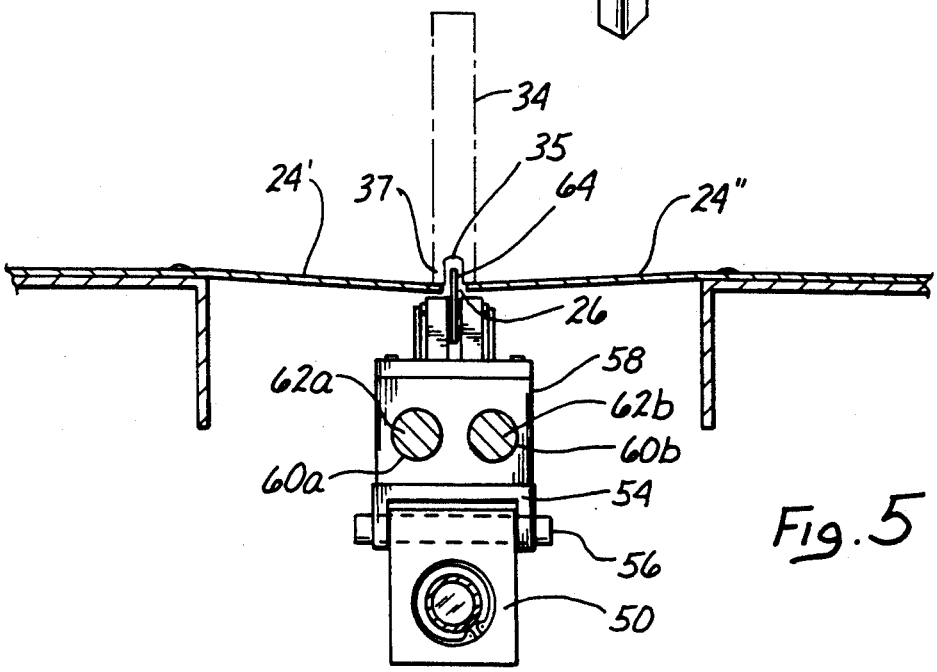
FIG. 5 is an elevation, partly in section, looking in the direction of the arrows 5—5 on FIG. 3.
Figure 2:
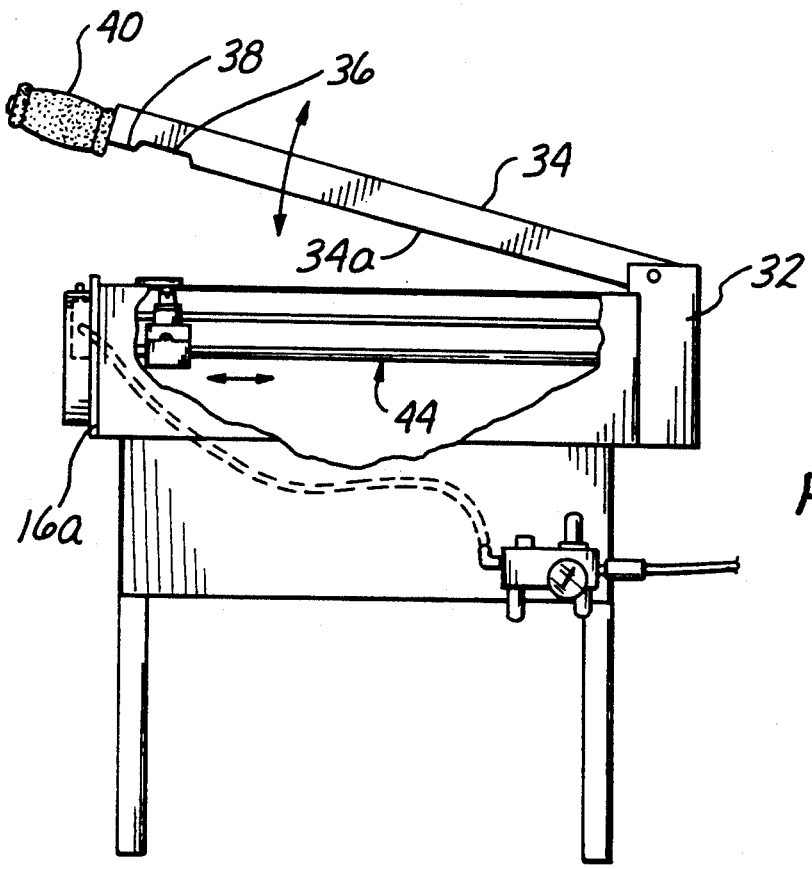
FIG. 2 is a side elevation, partly broken away, looking in the direction of the right side of the apparatus shown in FIG. 1.
Figure 6:
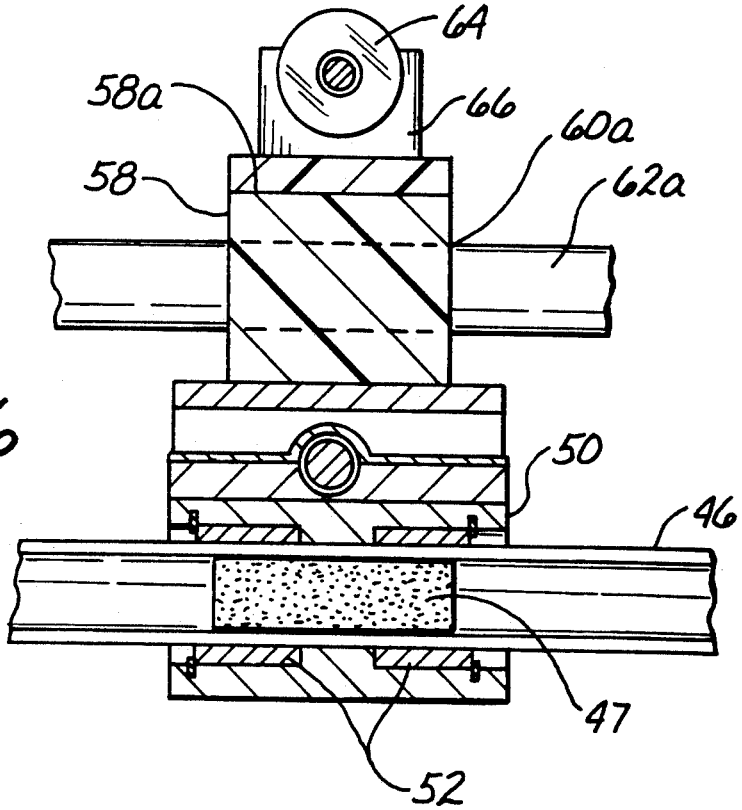
FIG. 6 is an enlarged detail of the rodless cylinder, carrier, mounting block, support tubes and blade shown in FIG. 3.
Figure 3:
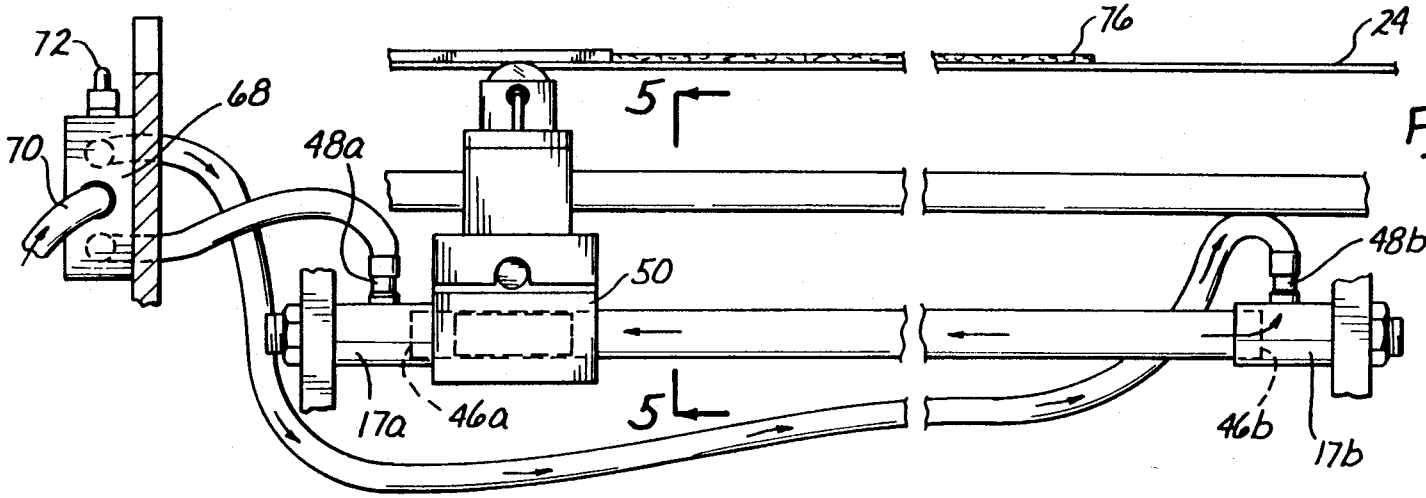
FIG. 3 is an enlarged detail of a portion of the apparatus shown in FIG. 2.
Figure 4:
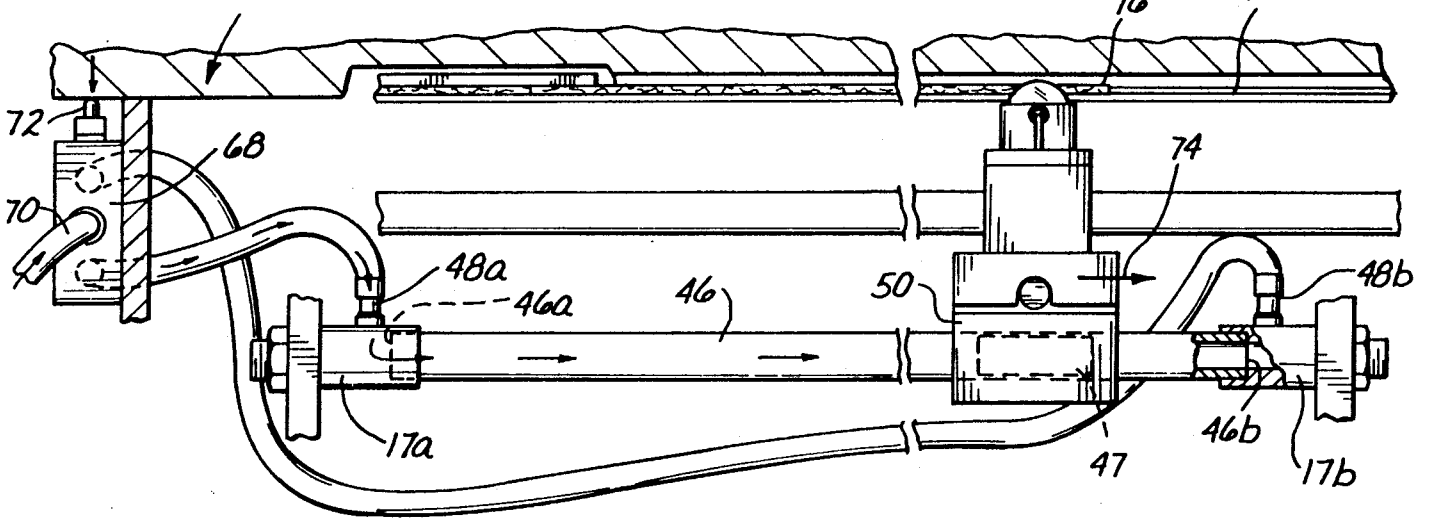
FIG. 4 is a view similar to FIG. 3 but showing the carrier and its blade moved toward its second position.

Turning next to FIGS. 2 through 6 which illustrate the various components of the operating mechanism, a rodless cylinder 44 extends between the side panels 16*a* and 16*b*, with its ends being inserted in mounting sleeves 17*a*, 17*b*, respectively. A suitable rodless cylinder 44 is one designated Ultran rodless cylinder US-04265-FSD manufactured by the Bimba Company of Manet, Ill. As best seen in FIGS. 3, 4, and 6, the rodless cylinder 44 comprises a tube 46 within which may be reciprocally driven a magnet 47 by air pressure which may enter the tube at one end 46*a* or the opposite end 46*b* through air pressure hoses 48*a* or 48*b*, respectively. As the magnet 47 is thus moved within the tube 46 by air pressure, entering from either tube end 48*a* or 48*b*, it moves correspondingly an external carrier 50 the inner cylindrical surface of which is provided with bushings 52. A U-shaped support element 54 may be secured to the carrier 50 by a bolt 56 onto which may be further secured by adhesive or other means a cutter mounting block 58. Desirably, this cutter block should be orificed at 60*a* and 60*b* through which orifices may be passed support tubes 62*a* and 62*b*, respectively. The cutter mounting block 58 may be of nylon, teflon or other plastic material which will produce a minimum of friction as the block 58 may be reciprocated along the tubes 62*a* and 62*b*. A suitable blade or other cutting element 64, preferably a circular rotating blade, as best shown in FIGS. 5 and 6, may be mounted by a supported axle device 66 on the upper face 58*a* of the block 58. It should also be noted from FIG. 5 that the arm 34 previously described is slotted at 35 along its lower edge 37.

The control box 30 houses a precision limit valve 68 of the type made by Nunitex, Inc. of Highland, Mich. This valve is placed in communication with the air pressure regulator 42 by means of a hose 70. The precision limit valve 68 may be actuated by a upwardly extending depressible rod or button 72 which is normally biased upwardly in which position air is directed into hose 48*b* to move and retain the magnet 47 in the tube 46 in its first position shown in FIG. 3. However, when the rod or button 72 is depressed, the air under pressure received through the hose 70 is redirected from hose 48*b* to hose 48*a* thereby driving the magnet 47 in the direction of the arrow 74 to move the carrier 50 towards its second position shown in FIG. 4.

In operation, a sheet 76 of fibrous or other material to be cut is placed on the top panel 24 and moved into a position over the slot 26. When the arm 34 is pulled down on top of the line of the sheet 76 over the slot 26 to the point where the land 38 at the distal end of the arm is brought into contact with the depressible rod or button 72 (as shown in FIG. 4), the precision limit valve is then actuated to cause the compressed air received from the air pressure regulator through the hose 70 to pass through the hose 48*a* into the end 46*a* of the tube 46. Thereby, the magnet 47 is driven in the direction of the arrow 74, together with the carrier 50, the block 58 and blade 64 to move the latter along the slot 26. Simultaneously, the lower edge 37 of the arm 34 will depress the sheet 76 overlying the depressible areas 24' and 24" of the top panel 24. Thereby, as the blade 64 is moved along the slot 26, it will sever the overlying sheet 76 along the slot line. Such severing will continue so long as the arm land 38 is maintained in contact with the rod or button 72. However, as soon as such contact is broken by elevating the arm 34, the precision limit valve 68 will cut off the air being passed to the hose 48*a* and shift it back to the hose 48*b* to immediately drive the magnet 47 back to its first position shown in FIG. 3.

It may be seen from the foregoing description of the invention with reference to the accompanying drawings that there is no possibility of an operator being cut by the blade unless he should deliberately depress the rod or button 72 while simultaneously pressing down on the areas 24' and 24" with his other hand. An operator cannot be cut when the arm is brought down since the blade 64, when moved to actuation of the precision limit valve, will be shielded by the notch 36 in the lower edge of the arm 34. The cutting is also very clean and does not result in any pulling or distortion of the sheet being cut. Further, control of the extent of the cut to be made is excellent since the direction of movement of the blade may be quickly reversed by lifting the land 38 from the depressible rod or button 72.

While the invention has been described with reference to an air pressure system, it will be obvious to persons skilled in the art that the cutting arrangement of the present apparatus may be readily adapted to an electrically controlled blade movement by substituting a reversible electric motor or servo motor to move the blade from its first to its second position, and vice versa.

I claim:

1. A device for cutting a sheet of fibrous or similarly severable material along a straight line, said device comprising:

a rectangular housing, said housing including at least first and second opposed vertical side panels spaced from each other, and a planar transverse top panel spanning the upper edges of said side panels, means to support said housing above a ground surface, a rectilinear slot in, and extending through, said top panel and extending substantially perpendicular to and between said first and second opposed vertical side panels, said slot being defined by a pair of opposed edges in the top panel, a rectilinear rod extending between, and supported by, the first and second side panels, said rod being disposed parallel to, and below, said slot, carrier means on, and reciprocally slideable along said rod between said first and second side panels, a cutter element supported by said carrier means, said cutter element having a blade extending upwardly from said carrier means to a vicinity of said slot wherein said cutter element is below and aligned with said slot, a portion of said top panel of the housing, including said pair of opposing edges, being downwardly depressible for at least a predetermined distance on each side of said slot wherein said opposed edges are depressed below at least part of said cutter element during cutting, powered means to drive said carrier means in a first direction from a first position on the rod adjacent the first side panel, to a second position along the rod away from the first side panel and toward the second side panel and for driving the carrier means back in a second direction opposite the first direction along the rod to the first position of the carrier means, means to provide driving power to the powered means, control means, said control means having an upwardly extending actuator element disposed in a vicinity of an end of the slot adjacent the first side panel, said control means being connected to the means to provide power to the powered means to drive the carrier means in its first direction when and only so long as downward pressure is applied to the actuating means, and otherwise said control means applies power to the powered means to drive the carrier means in the second direction to its first position and to maintain it in said first position, a rigid arm pivotably connected to the second side panel adjacent to and moveable toward the first side panel in line with the slot, said arm being pivotable between a first position removed from the slot, and a second position parallel to the slot wherein the rigid arm is in abutment with and depressing said pair of opposed edges edges of the top panel which define the slot, and with an end of the rigid arm remote from its pivot in contact with the actuating element of the control means;

whereby when a sheet of fibrous or other severable material is placed over the slot and the rigid arm is pivoted down on to the portion of the material covering the edges of the top panel defining the slot, to depress said portion of the material and at least said portion of the top panel therebelow, and dispose the end of the rigid arm to contact and depress the actuating element of the control means, power is applied to drive the carrier means and its cutting element in the first direction to sever the fibrous material above and along the slot so long as the rigid arm is held down to depress the actuating element of the control means, but when said rigid arm is elevated out of contact with the actuating element, the carrier means with its cutting element is driven back in the second direction to its first position.

2. A device for cutting a sheet of fibrous or similarly severable material along a straight line, said device comprising:

a housing, said housing including at least first and second opposed vertical side panels spaced from each other, and a planar transverse top panel, spanning the upper edges of said side panels, means to support said housing above a ground surface, a rectilinear slot in, and extending through, said top panel substantially perpendicular to and between said first and second opposed vertical side panels, said slot being defined by a pair of opposed edges in the top panel, a rectilinear rod extending between, and supported by, the first and second side panels, said rod being disposed parallel to, and below, said slot, carrier means on, and reciprocably slideable along said rod between said first and second side panels, a cutter element supported by said carrier means, said cutter element having a blade extending upwardly from said carrier means to a vicinity of said slot wherein said cutter element is below and aligned with said slot, a portion of said top panel of the housing, including said pair of opposed edges, being downwardly depressible for at least a predetermined distance on each side of said slot wherein said opposed edges are depressed below at least part of said cutter element during cutting, powered means to drive said carrier means in a first direction from a first position on the rod adjacent the first side panel, to a second position along the rod away from the first side panel and toward the second side panel and for driving the carrier means back in a second direction opposite the first direction along the rod to the first position of the carrier means, means to provide driving power to the powered means, control means, said control means having an actuator element disposed in a vicinity of an end of the slot adjacent the first side panel, said control means being connected to the means to provide powered to the power means to drive the carrier means in its first direction when and only so long as operative contact is made with the actuating means, and otherwise said control means applies power to the powered means to drive the carrier means in the second direction to its first position and to maintain it in said first position, a rigid arm pivotably connected to the second side panel adjacent to and rotatable about a pivot toward the first side panel and in line with the slot, said arm being pivotably between a first position removed from the slot, and a second position parallel to the slot wherein an edge of the rigid arm is in abutment with and depressing said pair of opposed edges of the top panel which define the slot and wherein an end of the rigid arm distal from its pivot is in contact with the actuating element of the control means;

whereby when a sheet of fibrous or other severable material is placed over the slot and the rigid arm is pivoted down on to the portion of the material covering the edges of the top panel defining the slot to depress said portion of the material and at least said portion of the top panel therebelow, and dispose the end of the rigid arm in operative contact with the actuating element of the control means, power is applied to drive the carrier means and its cutting element in the first direction to sever the fibrous material above and along the slot so long as the lever is held in operative contact with the actuating element of the control means, but when said rigid arm is elevated out of contact with the actuating element, the carrier means with its cutting element is driven back in the second direction to its first position.

3. The device as described in claim 2 wherein the powered means comprises a rodless cylinder and said means to provide driving power to the powered means and said control means comprise an air compressor system and a precision limit valve, respectively, whereby air under pressure may be delivered to either end of the rodless cylinder as determined by actuation of the precision limit valve.

4. The device as described in claim 2 wherein the cutter element comprises an axle mounted on the carrier means transverse to and below the slot and a cutter wheel rotatable on said axle.

5. The device as described in claim 2 wherein the edge of the rigid arm which is brought into abutment with the edges of the top panel is wider than the slot and is itself slotted centrally lengthwise to permit the cutting wheel to project at least slightly into the arm edge without making contact therewith.

6. The method of cutting a sheet of fibrous paper type material which comprises the steps of:

(a) providing a platform on which the sheet may be laid;

(b) providing a transverse slot in the platform where the cut is to be made in the sheet;

(c) providing for an area of the platform on each side of the slot to be depressible;

(d) laying the sheet on the platform across the slot and depressible areas;

(e) providing a cutting element aligned with and adjacent the slot to be reciprocably driven back and forth below the slot;

(f) providing control means which upon actuation drive the cutting element in a first predetermined direction along the slot and which upon de-actuation drive the cutting element in a second direction opposite the first direction upon deactuation;

(g) providing means to actuate said control means to drive the cutting element in said first predetermined direction while simultaneously depressing the sheet overlaying the slot and the depressible areas on each side of the slot below at least a portion of the cutting element, and to de-actuate said control means and simultaneously cease depressing said sheet and said depressible areas, after said cutting element has been driven in said first predetermined direction to the extent desired; and (h) cutting the sheet by simultaneously depressing said sheet below at least a portion of the cutting element and actuating said control means causing the cutting element to be driven by said control means.

* * * * *